US009003572B2

(12) United States Patent
Knorr et al.

(10) Patent No.: US 9,003,572 B2
(45) Date of Patent: Apr. 14, 2015

(54) HANGER FOR A LAVATORY TREATMENT DEVICE

(75) Inventors: Stella Louise Knorr, Brighton (AU); Sasha Miu, Brunswick (AU); Adrian Charles Ian Scott-Murphy, Surrey Hills (AU); Saravanabhavan Selvalingam, Highton (AU)

(73) Assignee: Reckitt Benckiser LLC, Parsippany, NJ (US)

( * ) Notice: Subject to any disclaimer, the term of this patent is extended or adjusted under 35 U.S.C. 154(b) by 419 days.

(21) Appl. No.: 13/503,914

(22) PCT Filed: Sep. 30, 2010

(86) PCT No.: PCT/GB2010/051629

§ 371 (c)(1), (2), (4) Date: Nov. 9, 2012

(87) PCT Pub. No.: WO2011/051695

PCT Pub. Date: May 5, 2011

(65) Prior Publication Data

US 2013/0112830 A1 May 9, 2013

(30) Foreign Application Priority Data

Oct. 27, 2009 (GB) ..... 0918759.2

(51) Int. Cl.

*E03D 9/02* (2006.01)
*E03D 9/00* (2006.01)
*E03D 9/03* (2006.01)

(52) U.S. Cl.

CPC ..... *E03D 9/00* (2013.01); *Y10T 29/49826* (2015.01); *E03D 9/032* (2013.01); *E03D 2009/024* (2013.01)

(58) Field of Classification Search

CPC ..... E03D 9/032; E03D 9/00; E03D 2009/024
USPC ..... 248/213.2, 213.4, 214, 339; 4/231; 422/263, 266
See application file for complete search history.

(56) References Cited

U.S. PATENT DOCUMENTS 4,261,957 A * 4/1981 Schimanski ..... 422/263
4,455,692 A 6/1984 Hegge et al.
5,375,799 A * 12/1994 Rhodes ..... 248/95

FOREIGN PATENT DOCUMENTS

WO 2007107769 A1 9/2007
WO 2009034304 A1 3/2009

OTHER PUBLICATIONS

GB Search Report for GB0918759.2 dated Jan. 14, 2010.
International Search Report for PCT/GB/051629 dated Jan. 28, 2011.
Written Opinion of the International Searching Authority for PCT/GB/051629 dated Jan. 28, 2011.

* cited by examiner

*Primary Examiner* — Todd M Epps
(74) *Attorney, Agent, or Firm* — Norris McLaughlin & Marcus PA

(57) ABSTRACT

An improved hanger 19 for a lavatory treatment device 10 which comprises: a top plate portion 20 which from an approximate midpoint 21, depends a downwardly extending stalk 22, wherein the top plate portion 20 includes a left arm section 20A section and a right arm section 20B which extends outwardly from the midpoint 21 and in a forward direction with respect to the stalk 22, wherein the left arm section 20A and the right arm section 20B are preferably essentially symmetrical about the midpoint 21 and are angled forwardly with respect to the stalk 22, and at the ends of each of the left arm section 20A section and a right arm section 20B are each a downwardly extending to grip arm, 23A, 23B, which grip arms 23A, 23B are parallel and spaced part from one another, and also each is located forward of the stalk 22.

12 Claims, 6 Drawing Sheets

HANGER FOR A LAVATORY TREATMENT DEVICE

This is an application filed under 35 USC 371 of PCT/GB2010/051629.

The present invention relates to a hanger for a lavatory treatment device. More particularly the present invention relates to a hanger for a lavatory treatment device which is used to position said device in the immediate proximity of a toilet bowl.

The prior art has suggested various hangers which are useful with devices for providing a technical effect, e.g., delivering a treatment composition, providing a cleaning composition, providing an air treatment benefit to a lavatory appliance, e.g., a urinal, bidet or toilet. Examples of such hangers and devices comprising hangers include the following: U.S. Pat. Nos. 1,880,912, 2,011,732, 2,985,377, 3,088,126, 3,290,699, 3,604,021, 3,947,901, 4,143,431, 4,247,070, 4,301,556, 4,455,692, 5,206,959, and 6,817,040. While each are in some respect satisfactory, there nonetheless remains a real and urgent need in the art for further improved hangers for a lavatory treatment device, as well as lavatory treatment devices comprising such an improved hanger.

It is to these and as well as further objects that are addressed by the present invention.

According to first aspect, there is generally provided an improved hanger for a lavatory treatment device.

According to a second aspect, there is provided a lavatory treatment appliance which comprises an improved hanger according to the first inventive aspect.

In a third aspect, the present invention provides for a method for removably mounting and positioning a lavatory treatment device in the immediate proximity of a part of a lavatory appliance, and especially a toilet bowl, which method comprises the steps of: providing an improved hanger for a lavatory treatment device and/or a lavatory treatment appliance which comprises such an improved hanger and, removably mounting affixing a part of the improved hanger to a part of a lavatory appliance, and thereby positioning the lavatory treatment appliance or a depending lavatory treatment device in the immediate proximity of the lavatory appliance.

In a fourth aspect of the invention, there is provided a method according to the third aspect, wherein the lavatory appliance is a toilet, and the hanger is removably affixed to a part of the rim of the toilet bowl such that the depending lavatory treatment device is suspended within the interior of the toilet bowl, or outside of the toilet bowl but approximately adjacent to the rim thereof.

These and further aspects of the invention will be better understood from a reading of the following disclosure and the accompanying drawings. In the accompanying drawings like numerals are employed to designate like parts throughout the same.

Figure 7A:
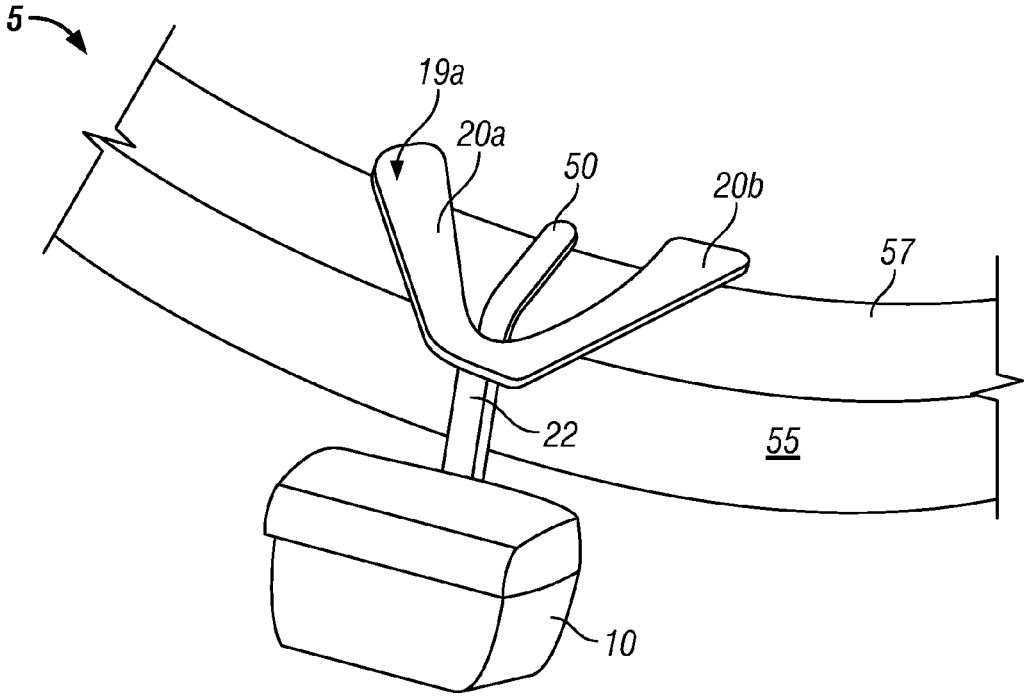
Figure 7B:
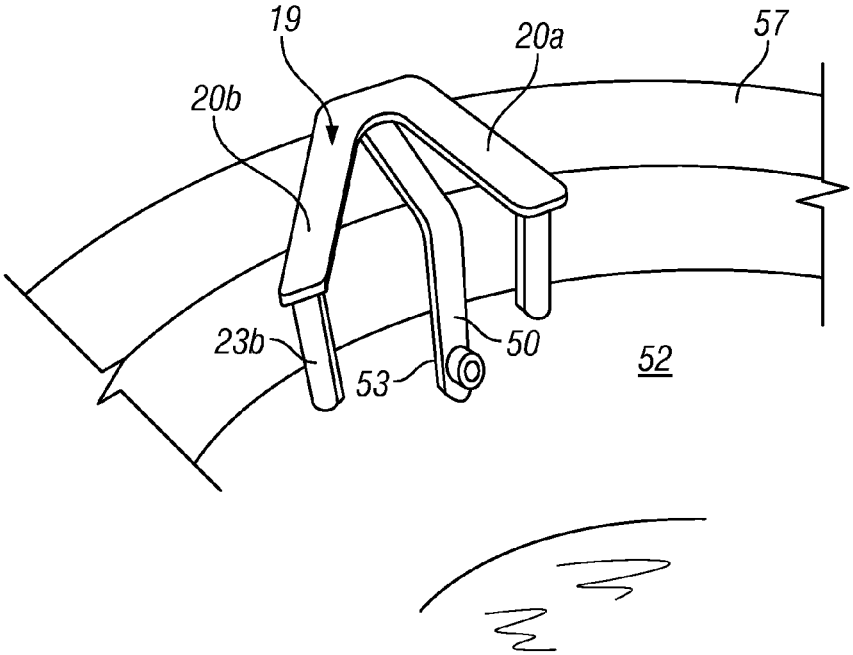

FIGS. 7A and 7B respectively illustrate a perspective view of a further embodiment of the improved hanger and a lavatory treatment appliance according to the invention, mounted upon a portion of the rim of a toilet bowl.

Figure 8A:
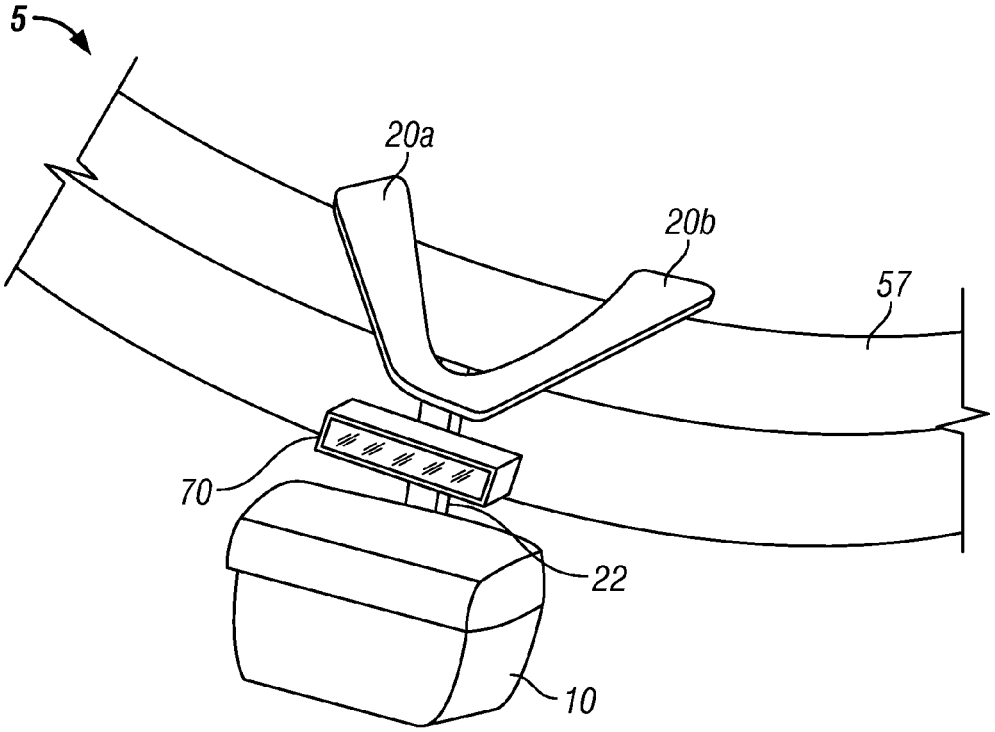
Figure 8B:
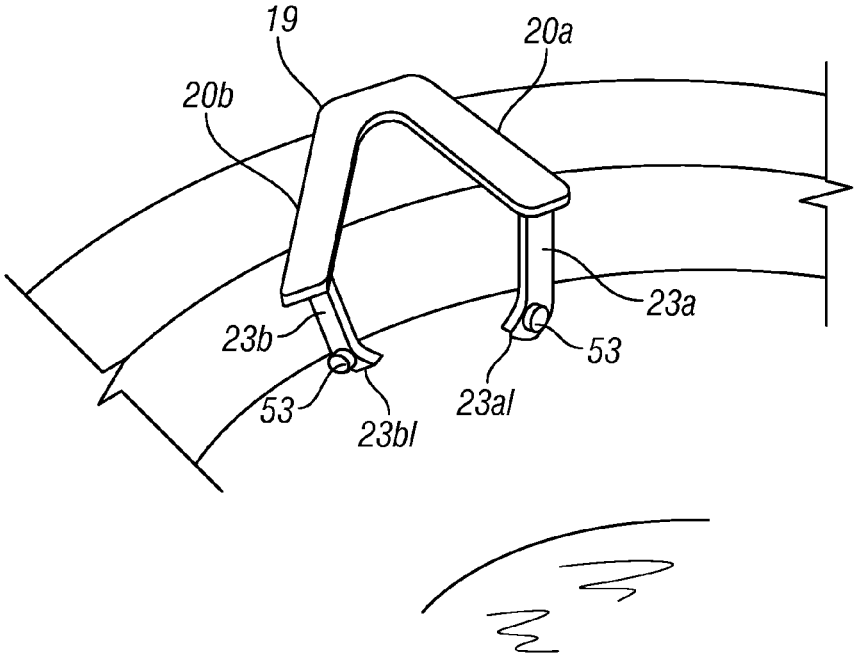

FIGS. 8A and 8B respectively illustrate a perspective view of a further embodiment of the improved hanger and a lavatory treatment appliance according to the invention, mounted upon a portion of the rim of a toilet bowl.

Figure 9:
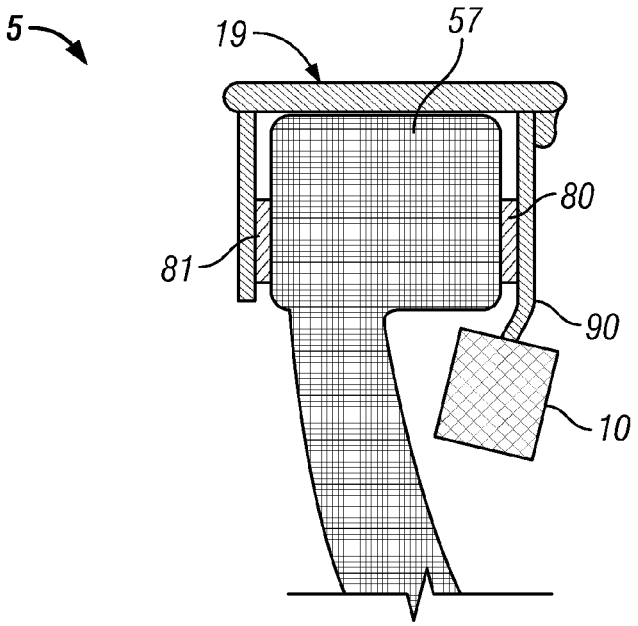

FIG. 9 depicts a side, partial cross-sectional view of a further embodiment of a lavatory treatment appliance and improved hanger removably mounted upon the rim of a toilet bowl.

Figure 10:
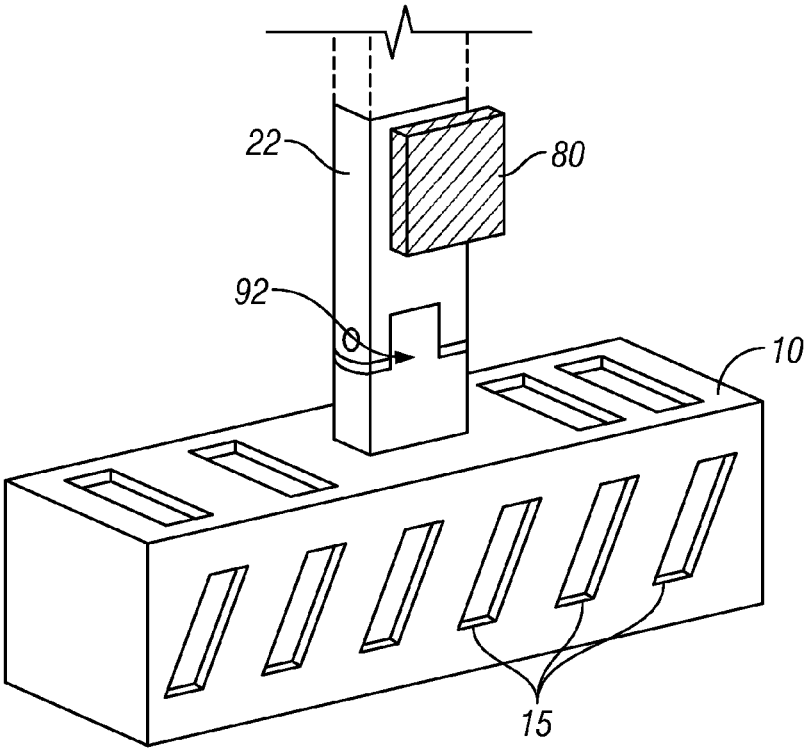

FIG. 10 depicts a detailed perspective view of a part of the lavatory treatment appliance and hanger of FIG. 9.

Figure 1:
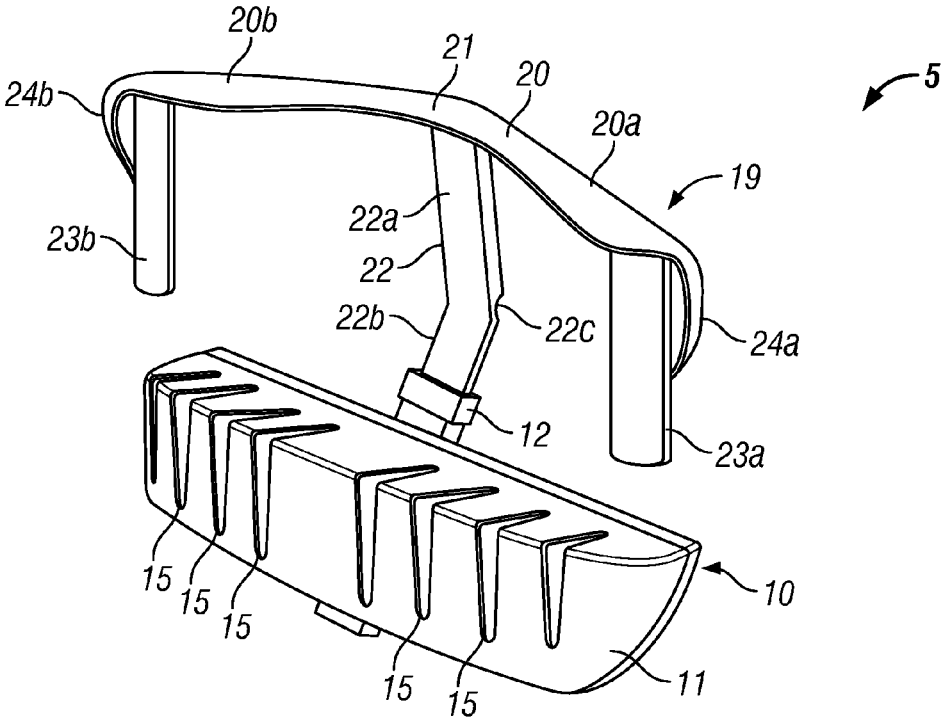
FIG. 1 depicts in a perspective view the front of a preferred embodiment of a lavatory treatment appliance including an improved hanger.
Figure 2:
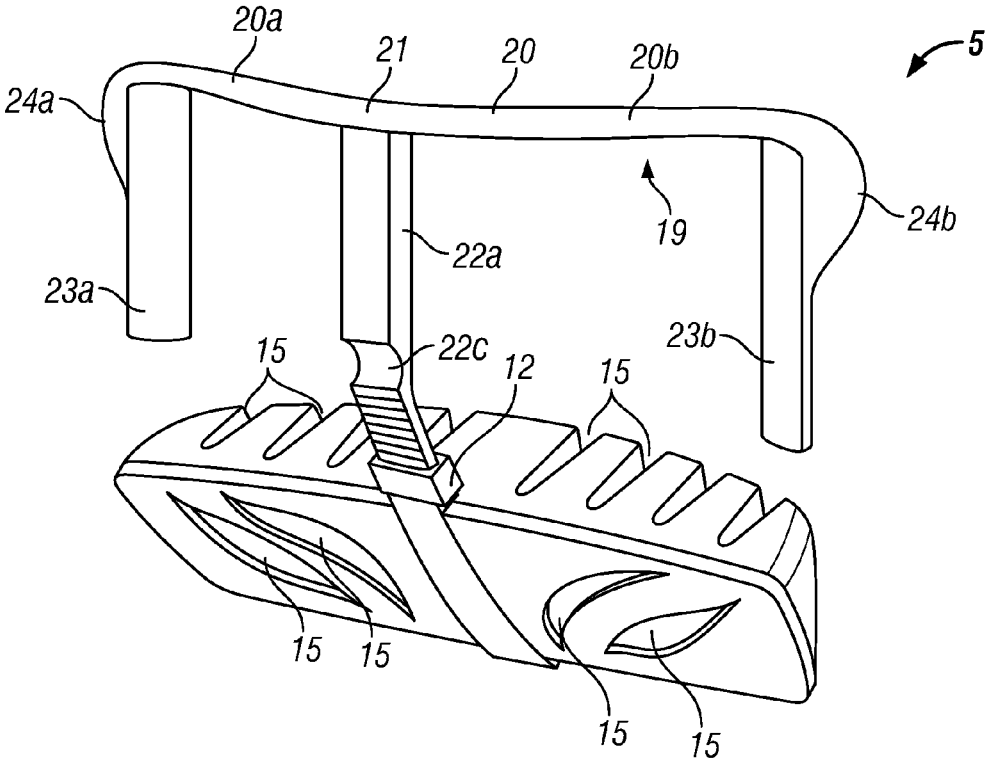
FIG. 2 depicts a rear perspective view of the lavatory treatment appliance and improved hanger of FIG. 1.
Figure 4:
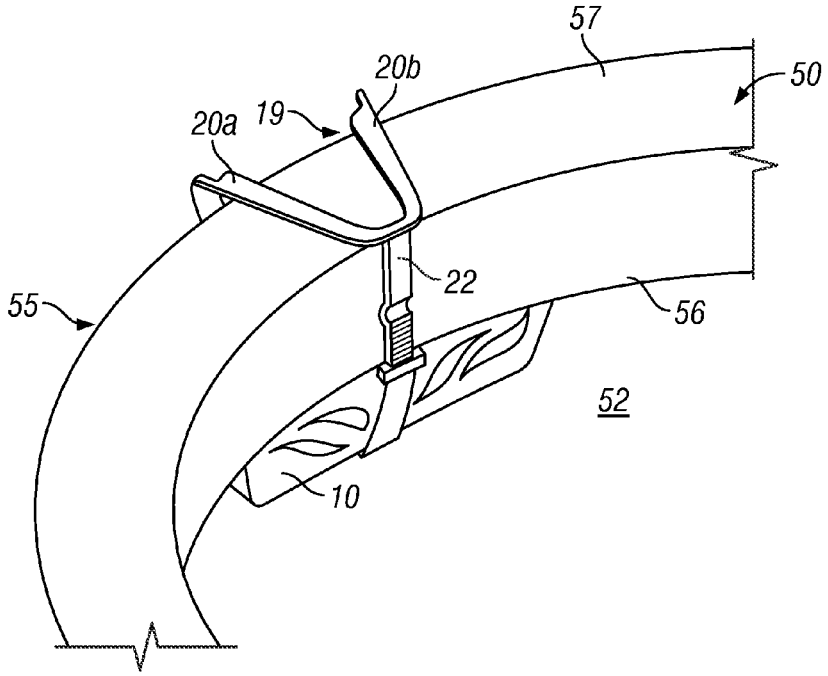
FIG. 4 depicts a view of the lavatory treatment appliance and improved hanger of FIGS. 1 and 2 removably mounted upon the rim of a toilet bowl.
Figure 5:
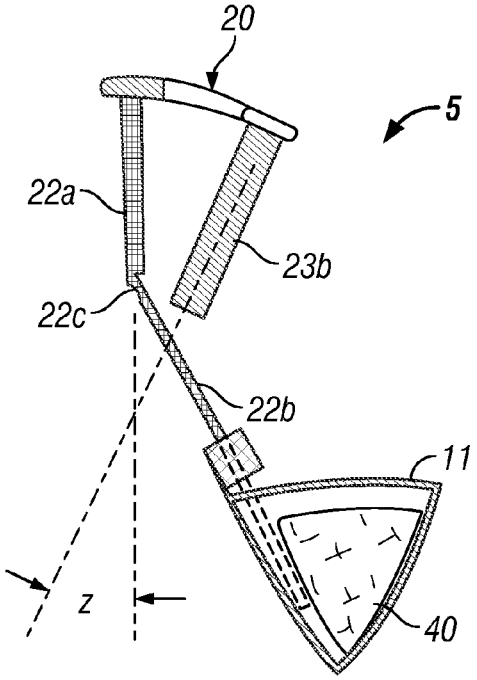
FIG. 5 depicts a side, partial cross-sectional view of the lavatory treatment appliance and improved hanger of FIGS. 1 and 2.
Figure 6:
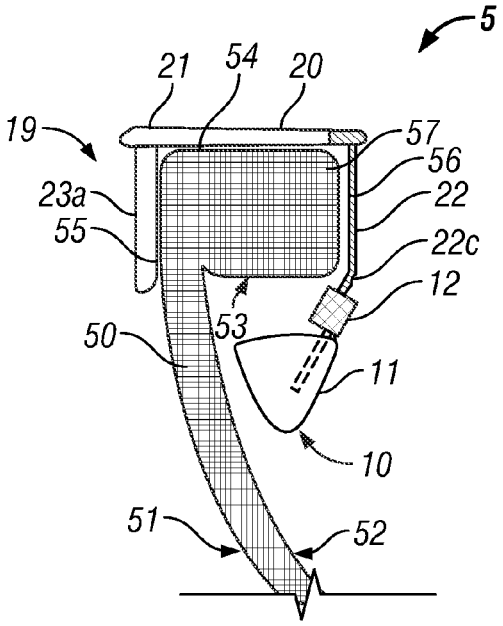
FIG. 6 depicts a side, partial cross-sectional view of the lavatory treatment appliance and improved hanger of FIG. 3 removably mounted upon the rim of a toilet bowl.

With reference now to FIGS. 1 and 2, there is depicted a lavatory treatment appliance 5 which comprises a lavatory dispensing device 10 which is affixed to, and which depends from, a hanger 19 via an intermediate coupling 12. The hanger 19 includes a top plate portion 20 which from an approximate midpoint 21, depends a downwardly extending stalk 22 which extends downwardly towards the intermediate coupling 12. In the depicted embodiment, the stalk 22 includes an upper stalk section 22A, a lower stalk section 22B, and here, an angled midsection 22C ,which operates to divert the direction of the downwardly extending stalk 22 such that the approximately vertical stalk section 22A is diverted forwardly at its lower stalk section 22B due to the introduced angle imposed by the angled midsection 22C. In certain preferred embodiments, the configuration of the stalk 22 in the manner disclosed is advantageous in that it provides for improved placement of the lavatory dispensing device 10 with relation to part of a lavatory appliance, however, such is not required and it is foreseen that the stalk 22 may be essentially linear in its configuration, or may have an angled midsection 22C which diverts the direction of the downwardly extending stalk 22 rearwardly, or may include one or more angled midsections which introduce various plural degrees of diversion to the stalk 22. Indeed it is also foreseen that the stalk 22 may be flexible so that it may include elements or be formed of a material which allows it to be bent from a first configuration, e.g., an essentially linear configuration, to assume a further configuration which is retained, and which may optionally be still further reconfigured, such as by manually bending the stalk 22 or other portions of the lavatory treatment appliance 5. The top plate portion 20 includes a left arm section 20A section and a right arm section 20B which extends outwardly from the midpoint 21 and in a forward direction with respect to the stalk 22. The left arm section 20A and the right arm section 20B are most desirably essentially symmetrical about the midpoint 21 and further are angled forwardly. At the ends of each of the left arm section 20A section and a right arm section 20B is a downwardly extending to grip arm, respectively 23A and 23B. with respect to one other, each of the grip arms 23A, 23B are preferably parallel and spaced part from one another, and also each is located forward of the stalk 22. In certain preferred embodiments, the orientation of stalk 22, preferably at least the upper stalk section 22A thereof, and each of the grip arms 23A, 23B are parallel with respect to one another, while in other preferred embodiments, the orientation of each of the grip arms 23A, 23B are parallel with respect to each other, but are angled with respect to the stalk 22, preferably at least the upper stalk section 22A thereof. Optionally but preferably, the hanger 19 includes, extending outwardly from the ends of each other the left arm section 20A section and a right arm section 20B and/or each of the grip arms 23A, 23B gripping tabs, respectively 24A and 24B which provide means for manual gripping of the hanger 19 by a user either installing, or removing the lavatory treatment appliance 5 and/or the hanger 10 from a lavatory appliance. With respect to the lavatory treatment device 10, in the embodiment illustrated in these figures there is depicted a cage 11 which is essentially a housing adapted to contain a quantity of a solid, liquid, or semi-solid, or gelled lavatory treatment composition, typically containing one or more of: surfactants, bleach, fragrance, disinfectant, anti-limescale treatment agent and the like which is removably mounted upon the rim of a toilet bowl such that water flushing from the underside of the rim of the toilet bowl enters into the interior of the cage 11 via one or more of the perforations 15, comes into contact with the lavatory treatment composition and thereafter exits the cage 11 from whence it flows and treats the interior surfaces of the toilet bowl. Such is suitably illustrated on FIG. 5 which depicts a side, partial cross-sectional view of the lavatory treatment device and improved hanger of FIGS. 1 and 2, wherein a lavatory treatment composition 40, here in the form of a cake or block is present within the interior of the cage 11. The cage 11 is movably affixed to the hanger 19 via a coupling 12, which is here intended to illustrate a friction type, or rack-and-pawl type of mechanical interconnection between the hanger 19 and the cage 11. Use of such a coupling 12 permits for slidable engagement between a least a portion of the stalk 22, here specifically part of the lower stalk section 22B such that the position of the cage 11 relative to the stalk 22 and thus, by default also relative to the position (and distance) of the top plate 20 of the hanger 19. Such also dictates the relative positioning in placement of the lavatory dispensing device 10 with respect to the rim of a toilet bowl, as is better illustrated on FIG. 6. As is visible from that figure, the hanger 19 from which the lavatory dispensing device 10 depends via the coupling 12, and stalk 22, is mounted upon a portion of a toilet bowl 50, specifically a portion of the rim 57 such that; the top plate 20 is above, and rests upon the top face 54 of the toilet bowl rim 57, a portion of the stalk 22 rests against a portion of the interior side face 56 of the toilet bowl rim 57, each of the grip arms 23A (23B is not visible in this figure) rests against a portion of the exterior side face 55 of the toilet bowl rim 57, or alternately rests against a portion of the exterior side wall 51 of the toilet bowl such that, one or more of the perforations 15 is located beneath the underside 53 of the toilet bowl rim 57 such that, during flushing of the toilet bowl, water and exiting via a part of the toilet bowl rim 57 is directed into or over the cage 11 of the lavatory dispensing device 10. Such a placement is also depicted on FIG. 4, illustrating the placement and positioning of the lavatory dispensing device 10 within the interior of the toilet bowl 50 such that the aqueous composition formed during flushing by the interaction of the flush water and the lavatory treatment composition 40 contacts the interior side wall 52 of the toilet bowl 50. In such manner, the interior of a toilet bowl 50 can it be treated by the use of a device according to the invention.

Figure 3:
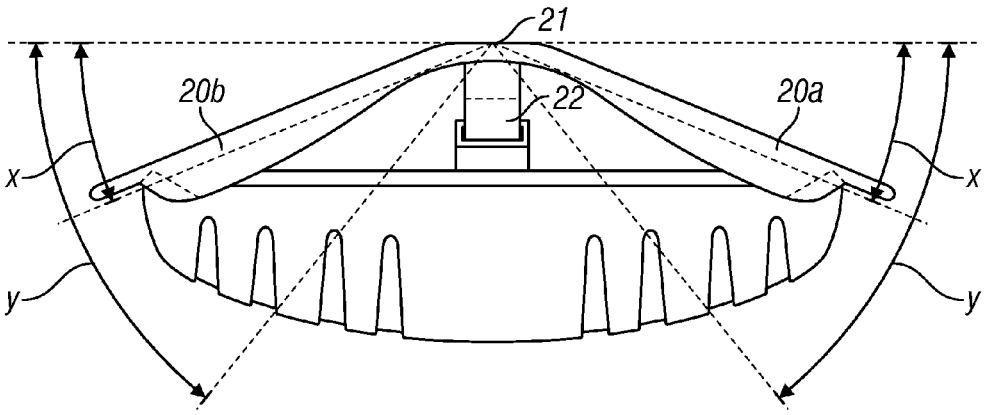
FIG. 3 depicts a top plan view of the lavatory treatment appliance and improved hanger of FIGS. 1 and 2.

FIG. 3 depicts a top plan view of the a lavatory treatment appliance 5 comprising the lavatory dispensing device 10 and improved hanger 19 of FIGS. 1 and 2, and more particularly provides for a depiction of the relative arrangements of the hanger 19, its top plate portion 20, and the relative positioning of the left arm section 20A section and a right arm section 20B which extends outwardly from the midpoint 21 and in a forward direction with respect to the downwardly extending stalk 22. In this figure, the relative position of the elements making up the hanger 19 are shown in an "unstressed" configuration, as would be expected prior to mounting of the lavatory dispensing device 10 and the hanger 19 upon a part of a lavatory appliance. In such a condition, both of the left arm section 20A section and a right arm section 20B extended forwardly by an angle of "x" degrees relative to a reference plane "W" drawn tangential to the stalk 22 at the midpoint 21 and equidistant from each of the left arm section 20A section and a right arm section 20B. In preferred embodiments, the value of "x" is between about 5-75 degrees of arc, preferably about 10-60 degrees of arc, and particularly preferably are between about 10-50 degrees of arc. According to the invention, it is required that each of the left arm section 20A section and a right arm section 20B be forwardly movable, that is to say, to form an even greater angle with respect to the reference plane W. Such which may be achieved by either a hinged interconnection between the left arm section 20A section and a right arm section 20B with parts of the hanger 19 and/or stalk 22 but more desirably and particularly advantageously the material of construction of the hanger 19 is sufficiently flexible or deformable to permit for plastic deformation of the hanger 19 in such a manner as shown in the figures. Advantageously then, the left arm section 20A section and a right arm section 20B can be moved forwardly such that they can assume an angle of it least about "y" degrees relative to the reference plane W. Optionally, but particularly advantageously, such plastic deformation introduces flexural stresses within parts of the hanger 19, such that in a "stressed" configuration, the properties of the material of construction seeks to return to its original "unstressed" configuration (or approximately thereto) its original "unstressed" configuration. In this manner, the hanger 19, optionally but preferably concurrently also having depending therefrom a lavatory dispensing device 10, operates to grip a portion of the lavatory appliance, particularly a toilet bowl upon which it is mounted, particularly as depicted on FIGS. 3 and 6. These internal stresses in the stressed configuration such that; the top plate 20 is above and rests upon the top face 54 of the toilet bowl rim 57; a portion of the stalk 22 rests against and is urged against a portion of the interior side face 56 of the toilet bowl rim 57; and concurrently each of the grip arms 23A, 23B rests against and are urged against a portion of the exterior side face 55 of the toilet bowl rim 57, or alternately rests against and are urged against a portion of the exterior side wall 51 of the toilet bowl. Thus, the effect of flexural stresses within the hanger 19 resulting in compressive effects urging each the grip arms 23A, 23B to move towards the stalk 22 provides for improved retention of the hanger 19 in the position in which it has been removably mounted. The hanger 19 can be easily mounted and easily compressed, such as by simultaneously gripping in each of the tabs 24A, 24B and manually compressing the hanger 19 to assume the stressed configuration wherein concurrently also, the distance between each of the grip arms 23A, 23B is greater than in an unstressed condition, installing the hanger 19 onto the part of the lavatory appliance, e.g., toilet, such as is illustrated in one or more of the accompanying figures, and thereafter releasing the tabs 24A, 24B thereby permitting the hanger 19 to engage a portion of the lavatory appliance, and assume a stressed configuration. When a lavatory dispensing device 10 has ceased to function, or has spent its contents, such a lavatory dispensing device 10 depending from the hanger 19 can be easily removed by again simultaneously gripping in each of the tabs 24A, 24B and manually compressing the hanger 19 to assume the stressed configuration thereby permitting the hanger 19 to be removably unmounted or withdrawn from the lavatory appliance.

Briefly returning to FIG. 5, there is illustrated an inventive embodiment wherein in an unstressed configuration the hanger 19, and in particular grip arms 23A, 23B are angled with respect to the stalk 22, and an angle of between about 3-45 degrees of arc, preferably an angle between about 5 and 40 degrees of arc, and particularly preferably an angle of between about 10-30 degrees of arc, as represented by "z". Such may occur wherein the top plate 20 is not flat and generally plainer as in prior illustrated configurations but is slightly curved. Alternately, the grip arms 23A, 23B and/or the stalk 22 need not be generally linear is illustrated in one or more of the foregoing figures, but can be slightly arcuate or curved along its respective lengths. In such a manner, a respective angle "z" may also be established.

Advantageously, in accordance with preferred embodiments, the cross-sectional or through-section of the top plate is desirably elliptical, but his preferably square, or is even more preferably rectangular initiate. Such ensures that upon establishing a "stressed" configuration the dislocation of the grip arms 23A, 23B will be more prone to be in a forwardly direction and thereby increasing the spacing between the stalk 22 and did the grip arms 23A, 23B, rather than in a in a rotational direction. However, while such are preferred, these are not necessarily limiting of the invention as any cross-sectional or through-sectional configuration may also be satisfactory.

FIGS. 7A and 7B present a perspective view of a further embodiment of the a lavatory treatment appliance 5 comprising the improved hanger 19 and a lavatory dispensing device 10 according to the invention, mounted upon a portion of the rim of a toilet bowl. The depicted embodiment is a similar in some respects to that disclosed and discussed with reference to prior figures, but differs in that: the a lavatory treatment appliance 5 is mounted in near proximity to, but upon the exterior of the toilet bowl; the hanger 19 is oriented such that the each the grip arms 23A, 23B are placed within the interior of the toilet bowl and when mounted, are urged against a portion of the interior side face 56 of the toilet bowl rim 57 while the stalk 22 rests against and is urged against a portion of the exterior side face 55 of the toilet bowl rim 57; and, wherein the lavatory dispensing device 10 includes further elements here, a fluid conduit portion 50 which extends there from, and extends downwardly into the interior of the toilet bowl. At the distal end 53 of the fluid conduit portion 50 is located a spray dispensing means 53 through which a liquid treatment composition can be dispensed to the interior of the toilet bowl such that it least a portion contacts the interior side wall 52 of the toilet bowl 50. The lavatory dispensing device 10 maybe any device which can fulfill such a function for example, may be a device generally in accordance with those devices described in U.S. Ser. No. 12/447,034 (corresponding to PCT/GB2008003086) the contents of which are here in fully incorporated by reference. Furthermore, the spray dispensing means maybe any suitable spray dispensing means disclosed in that document, or maybe other spray means known to the art.

FIGS. 8A and 8B illustrate in a perspective view a yet further embodiment of a lavatory treatment appliance 5 comprising an improved hanger 19 and a lavatory dispensing device 10 according to the invention, mounted upon a portion of the rim 57 of a toilet bowl 50. The embodiment of FIGS. 8A and 8B is similar in most regards to the embodiment of a treated on prior FIGS. 7A and 7B, but differs in that: they are provided two fluid conduit portions 50A, 50B which are integral elements of the hanger 19, and the a lavatory treatment appliance 5 additionally includes an air treatment composition dispenser means 70 which may be used to dispense into the ambient environment an air treatment composition. Such an air treatment means deliver a quantity of an air treatment composition or an air treatment constituent to the ambient environment within which the lavatory appliance, preferably the toilet bowl, is located. Such air treatment composition may be any fragrance or perfume composition, may be any odor treatment, odor masking or odor neutralizing composition, may be an insecticidal composition, or may be any air sterilizing compositions, or may be mixtures of any of the foregoing. The air treatment composition dispenser means 70 may be any article or device which suitably operates to dispense an air treatment composition to the ambient environment. By way of non-limiting example, the air treatment composition dispenser means 70 may be a reservoir which can take any shape or suitable form. By way of non-limiting examples, such a reservoir may include a porous material such as a pad or tablet which is impregnated with, or upon which is absorbed a volatile composition useful in providing an air treatment benefit, or a gel or a solid composition which also contains a volatile air treatment composition which may emanate from reservoir to the ambient environment.

With respect to the two fluid conduit portions 50A, 50B which are integral parts of the grip arms respectively 23A and 23B of the hanger 19, as is visible from this figure, the distal end 53 of the fluid conduit portion 50 is located a spray dispensing means 53 through which a liquid treatment composition can be dispensed to the interior of the toilet bowl such that it least a portion contacts the interior side wall 52 of the toilet bowl 50. The distal ends of the downwardly extending to grip arms 23A and 23B may also include an angled, rearwardly directed segments, respectively 23AL, 23BL as illustrated, which are configured to resemble the end of a hook, which may be beneficial in improving the placement and retention are the hanger 19. The spray dispensing means 53 may be mounted anywhere upon the hanger 19, preferably upon a part of the grip arms 23A and 23B in any part thereof, such as above the angled, rearwardly directed segments 23AL, 23BL or upon these angled, rearwardly directed segments 23AL, 23BL. It is to be further understood that while two spray dispensing means 53 are illustrated in FIG. 8B, the depicted device can include only one such spray dispensing means 53 which by way of example can be mounted on either grip arm 23A or grip arm 23B.

FIG. 9 depicts a side, partial cross-sectional view of a further embodiment of a lavatory treatment appliance 5 comprising a lavatory dispensing device 10 and improved hanger 19 removably mounted upon the rim 57 of a toilet bowl. In the illustrated embodiment, which shares many of the features of the embodiment illustrated in FIG. 6, but further includes: one or more retention pads 80, 81 intermediate portion of the hanger 19 and portions of the toilet rim 57, as well as a joint means 90 intermediates the hanger 19 and the lavatory dispensing device 10. With regard to the retention pads 80, 81 these can be any material, or elements which improves in increasing the interfacial friction between the portions of the hanger 19 upon which such retention pads 80, 81 are positioned and, the portions of the toilet rim 57 which these retention pads 80, 81 contact. Such retention pads can be way of nonlimiting example: foamed elastomeric material such as sponges; non-foamed elastomeric material such as naturally occurring or synthetic pads from natural rubber, or from synthetic polymers such as polyisoprene, latex rubber, and the like; adhesive materials such as glues which may be water-soluble glues to facilitate subsequent cleaning, as well as film forming synthetic polymers which may have adhesive properties. Such retention pads reduce slippage, particularly inadvertent slippage and displacement of the hanger 19 after it is mounted upon a toilet bowl rim 57. With regard to the joint means 90, such may be any physical element or device which allows for the separation of the lavatory dispensing device 10 from the hanger 19 without the necessity of removing the hanger 19 from its position mounted upon a toilet bowl rim 57 and/or is a flexible joints which allows for the repositioning of the lavatory dispensing device 10 with respect to the hanger 19, without necessarily displacing the device 10 with respect to the stalk 22. Advantageously such a joint means 90 may fulfill both of the aforesaid functions. The way of nonlimiting example, exemplary such joint means including hinges, hook and loop type fasteners, snap-type fittings such as ball and joint type fittings, pins, snap connectors means, friction fitting elements, and the like. Virtually, any means for mechanically connecting the hanger 19 and the lavatory dispensing device 10 may be considered suitable particularly where such means allows adjusting the relative position of the lavatory dispensing device 10 after mounting of the hanger 19.

FIG. 10 depicts a detailed perspective view of a part of the lavatory treatment device and hanger of FIG. 9 illustrating a preferred embodiment of the joint means 90, here depicted as a knuckle hinge element 92 forming part of the stalk 22. While not clearly depicted is to be understood that the particular knuckle hinge element 92 depicted may be mechanically snapped apart so to provide for easy separation of the hanger 19 from the lavatory dispensing device 10, and yet, when in its assembled configuration within the element 92 are sufficient frictional forces such that the configuration of the hanger 19 with the lavatory dispensing device 10 can be angled, and retained in such an angle as depicted on FIG. 9. In such a manner, the use of a joint means 90 allows for optimization of the placement of the lavatory dispensing device 10 within a toilet bowl.

Further, the provision of a separable joint means 90 permits for the provision of "refillable" embodiment of the lavatory treatment device, whereby a mounted hanger 19 can be retained upon a toilet bowl rim, and replacement lavatory dispensing devices 10 can be provided as needed without requiring on mounting war displacement of the mounted hanger 19.

According to a further aspect of the present invention there is provided a method for removably mounting and positioning a lavatory treatment device, particularly as disclosed in one or more of the figures which represent a preferred embodiment of the invention, in the immediate proximity of a part of a lavatory appliance, especially a toilet bowl, which method comprises the steps of: providing an improved hanger for a lavatory treatment device and/or a lavatory treatment device which comprises such an improved hanger as described herein, and, removably mounting affixing a part of the improved hanger to a part of a lavatory appliance, and thereby positioning a depending lavatory appliance in the immediate proximity of the lavatory appliance.

Both of the hanger 19 and the lavatory dispensing device 10 according to the invention can be made of any suitable material, but advantageously at least the hanger 19 is formed of a flexible material. Advantageously the use of a synthetic polymers including thermosettable or thermoformable synthetic polymers such as are widely used in casting or injection molding may be used. Exemplary synthetic polymers such as polyamides, polyolefins (e.g., polypropylene, polyethylene) as well as polyalkyleneterephalates (i.e., polyethylene terephthalate, polybutylene terephthalate), polystyrenes, polysulfones, polycarbonates as well as copolymers formed from monomers of one or more of the foregoing. One or more of such thermoformable or thermosetting synthetic polymers come into consideration as suitable materials of construction as such are typically easily formed into a desired configuration for an article, may have good flexural and deformation characteristics to assume both stressed and unstressed configurations for the hanger 19 as required, and are resistant to many chemicals. Of course other materials may be used as well where such are found to be suitable.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A hanger for a lavatory treatment device which comprises:

a top plate portion which, from an approximate midpoint, depends a downwardly extending stalk, wherein the top plate portion includes a left arm section and a right arm section which extends outwardly from the midpoint and in a forward direction with respect to the stalk, wherein the left arm section and the right arm section are preferably essentially symmetrical about the midpoint and are angled forwardly with respect to the stalk, and at the ends of each of the left arm section and the right arm section are each a downwardly extending to grip arm, which grip arms are parallel and spaced apart from one another, and also each is located forward of the stalk, wherein both of the left arm section and the right arm section are extended forwardly by an unstressed angle relative to a reference plane "W" drawn tangential to the stalk at the midpoint and equidistant from the left arm section and the right arm section, and wherein each of the left arm section and the right arm section are forwardly moveable with respect to the stalk to form a stressed angle relative to the reference plane "W" which is greater angle than the unstressed angle.

2. A hanger for a lavatory treatment device according to claim 1, wherein, the stalk, and each of the grip arms are parallel with respect to each another.

3. A hanger for a lavatory device according to claim 1, wherein each of the grip arms are parallel with respect to each other, but are angled with respect to the stalk.

4. A hanger for a lavatory device 10 according to claim 1, wherein the stalk includes an upper stalk section, a lower stalk section, and an angled midsection, which angularly diverts the direction of the downwardly extending stalk such that the lower stalk section is angled forwardly with respect to the approximately vertical upper stalk.

5. A hanger for a lavatory device according to claim 1, wherein both of the left arm section and the right arm section extend forwardly by an angle of "x" degrees relative to the reference plane "W" drawn tangential to the stalk at the midpoint and equidistant from each of the left arm section and the right arm section and wherein, the value of "x" is between about 5-75 degrees of arc.

6. A hanger for a lavatory device according to claim 1, wherein the grip arms are angled with respect to the stalk, and are at an angle of between about 3-45 degrees of arc.

7. A lavatory treatment appliance 5 which comprises a lavatory dispensing device and the hanger according to claim 1.

8. A hanger for a lavatory device according to claim 5, the value of "x" is between about 10-60 degrees of arc.

9. A hanger for a lavatory device according to claim 8, the value of "x" is between about 10-50 degrees of arc.

10. A hanger for a lavatory device according to claim 6, wherein the grip arms are angled with respect to the stalk, and arc at an angle of between about 5 and 40 degrees of arc.

11. A hanger for a lavatory device according to claim 10, wherein the grip arms are angled with respect to the stalk, and arc at an angle of between about 10-30 degrees of arc.

12. A method for removably mounting and positioning a lavatory treatment device in the immediate proximity of a part of a toilet bowl, which method comprises the steps of:

providing a hanger according to claim 1, and, removably mounting the lavatory treatment device by affixing a part of the hanger to a part of the toilet bowl by stressing the hanger to cause plastic deformation of the hanger and positioning the lavatory treatment appliance upon or within the toilet bowl.

* * * * *